US007195508B1

(12) United States Patent
Ju

(10) Patent No.: US 7,195,508 B1
(45) Date of Patent: Mar. 27, 2007

(54) ELECTRIC CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/217,378

(22) Filed: Sep. 2, 2005

(51) Int. Cl.
*H01R 13/625* (2006.01)
*H01R 4/50* (2006.01)

(52) U.S. Cl. ..... 439/342; 439/876

(58) Field of Classification Search ..... 439/342, 439/876, 259, 625
See application file for complete search history.

(56) References Cited

U.S. PATENT DOCUMENTS 5,588,861 A * 12/1996 Townsend ..... 439/342
5,658,160 A * 8/1997 Lai ..... 439/342
5,688,140 A * 11/1997 McHugh et al. ..... 439/342
5,947,778 A * 9/1999 Lai et al. ..... 439/876
6,042,413 A * 3/2000 Hsiao et al. ..... 439/342
6,083,028 A * 7/2000 Pei et al. ..... 439/342
6,431,899 B1 * 8/2002 Keller ..... 439/342
6,439,912 B1 * 8/2002 Andric et al. ..... 439/342
6,482,022 B2 * 11/2002 Trout et al. ..... 439/342
2002/0151203 A1 * 10/2002 Sagano et al. ..... 439/342
2003/0220007 A1 * 11/2003 Huang ..... 439/342
2004/0005800 A1 * 1/2004 Hou ..... 439/342
2004/0115981 A1 * 6/2004 Wang ..... 439/342

* cited by examiner

*Primary Examiner*—Tulsidas C. Patel
*Assistant Examiner*—Vladimir Imas
(74) *Attorney, Agent, or Firm*—Troxell Law Office, PLLC

(57) ABSTRACT

An electric connector includes a body and a plurality of terminals received in the body. The surface of the body has a receiving surface for receiving electric elements. The receiving surface has a plurality of inserting holes and a plurality of ribs for receiving the electric elements. Besides, the ribs pass through the full receiving surface. Comparing to the prior arts, the situation of the central area of the upper cover out of shape is avoided so as to assure the central processing unit CPU chip module without damage in shaking circumstance.

8 Claims, 3 Drawing Sheets

ELECTRIC CONNECTOR

BACKGROUND OF THE INVENTION (a) Field of the Invention

The present invention relates to connectors, and particularly to an electric connector for the electric connection between a chip module and a circuit board.

(b) Description of the Prior Art

With the improvement of technology, electric connectors of zero insertion force CPU sockets become more and more popular. Prior arts are referring to China patent No. 95223360. The prior art presents an electric connector of a zero insertion force CPU socket, comprising an upper cover, a seat and a retaining spindle. The seat has a plurality of terminal slots inserting correspondingly in the same numbers of the conductive terminals. The retaining spindle is installed in one side of the seat. Besides, the upper cover is slideable with respect to the surface of the seat. The defects of the electric connector of a zero insertion force CPU socket are described as the followings. When the CPU is inserted in an electric connector for operation thereof, the retaining spindle must be pushed so that the upper cover moves towards to far distantance of the joint of the retaining spindle. According to tolerant force analysis, the upper cover receives two different forces. One is the resistance force induced from CPU pins moving towards the opposite direction of the upper cover. The other is the pushing force induced from the joint of the retaining spindle moving towards the same direction of the upper cover. The two different forces exert pressures on the upper cover so that the central part thereof becomes warped. The greater friction is produced between the upper cover and the seat so that larger force is needed when the retaining spindle is pushed downwards. The greater friction causes the operation to be inconvenient. Furthermore, in an extreme situation the two different forces may cause the central part of the CPU raised so as to prevent from the all pins of the CPU in contact with the terminals of the electric connector.

Therefore, it is necessary to develop a novel electric connector to overcome the above-mentioned defects.

SUMMARY OF THE INVENTION

Accordingly, the primary object of the present invention is to provide an electric connector. The electric connector ensures the better electric connection between a chip module and a circuit board.

In order to achieve the object of the present invention, the electric connector for electric connection of a chip module of the present invention comprises: a seat; an upper cover connecting movably to the seat; and a driving device. The upper cover has a conductive electric area. The conductive electric area has a plurality of ribs. Comparing to the prior arts, the conductive electric area on the upper cover of the electric connector has a plurality of ribs so as to increase the strength of the upper cover. When the upper cover is pressed, the upper cover is avoided to become warped so as to operate conveniently thereof. Therefore, the electric connector has the better electric connection of the chip module.

The various objects and advantages of the present invention will be more readily understood from the following detailed description when read in conjunction with the appended drawing.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
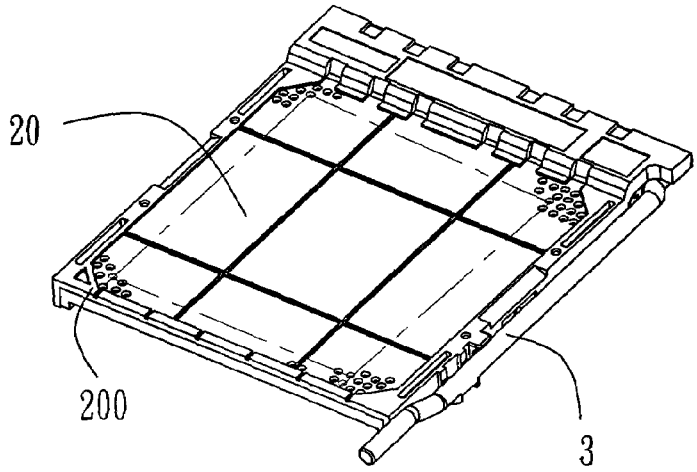
FIG. 1 is a perspective view of the electric connector of the present invention.
Figure 2:
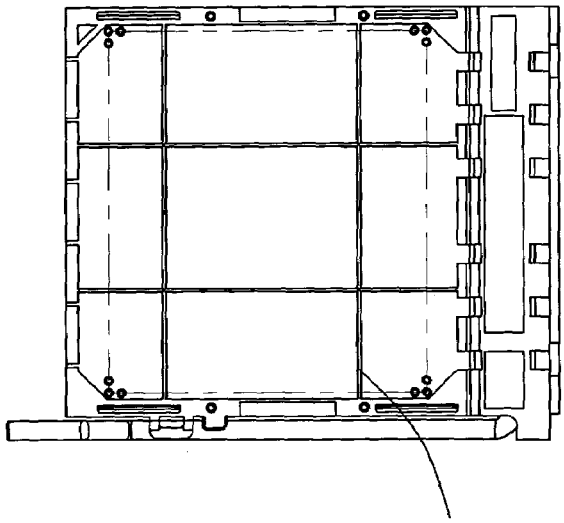
FIG. 2 is a vertical view of the electric connector of the present invention.
Figure 3:
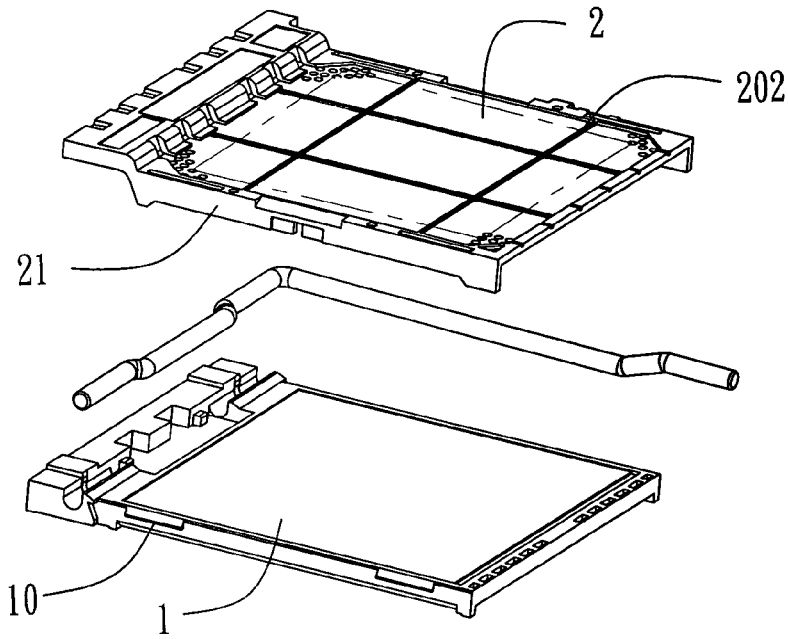
FIG. 3 is a perspective view showing the decomposition of the electric connector of the present invention.
Figure 4:
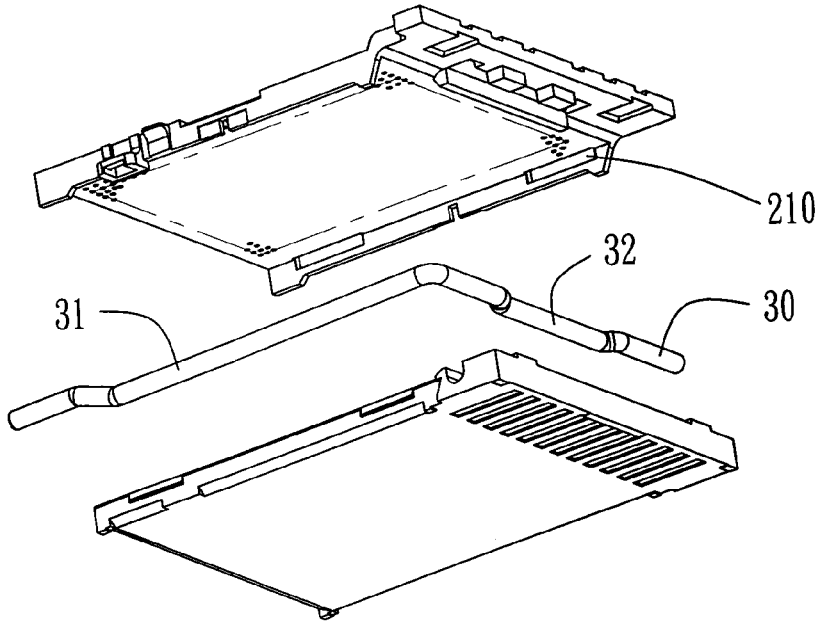
FIG. 4 is another perspective view showing the decomposition of the FIG. 3.
Figure 5:
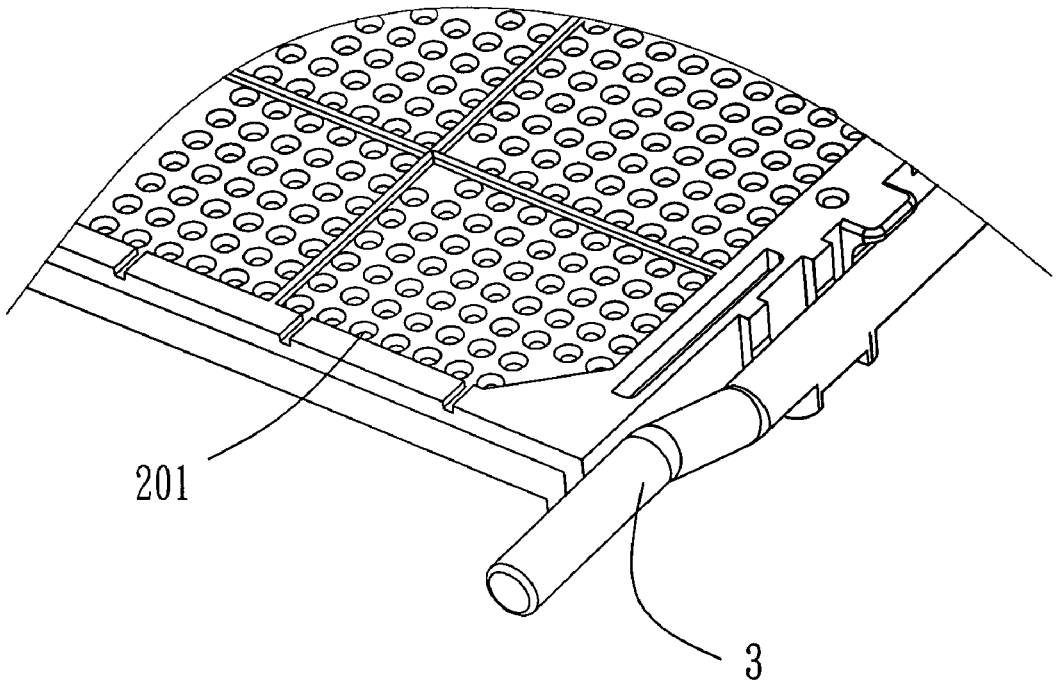
FIG. 5 is a perspective view of the inserting holes and the joystick of the electric connector of the present invention.

With reference to FIGS. 1 to 5, the electric connector of the present invention is installed in a circuit board (not shown) for connecting electric elements (in this embodiment, the element is central processing unit CPU chip module) (not shown). The connector includes a body and a plurality of terminals (not shown) received in the body.

The body has a seat 1, an upper cover 2 slidable with respect to the seat 1, and a joystick 3 slideable with respect to upper cover 2 and the seat 1. The joystick 3 has a spindle 30, an operation portion 31 approximately vertically to the spindle 30 and a pressing portion 32 protruded from the spindle 30 (it may be a cam or other driving device). By rotating the joystick 3, the upper cover 2 is openable or closeable with respect to the seat 1.

The seat 1 is made of insulating material which has an approximate rectangular shape. The seat 2 has a plurality of terminal receiving slots (not shown) for receiving conductive terminals. The conductive terminals are positioned in the terminal receiving slots. Two lateral walls of the seat 1 are installed with a plurality of strips 10 matchable to the upper cover 2.

The upper cover 2 is slideably assembled to the seat 1 and is made of insulating material which has an approximate rectangular shape. The upper cover 2 has a receiving surface for receiving a central processing unit. The four corners of the receiving surface 20 have edge frames 200 which are spaced from the corners. A plurality of inserting holes 201 with respect to the terminal receiving slots of the seat 1 are formed in the receiving surface 20 for receiving the pins of the central processing units. The areas of the inserting holes 201 on the receiving surface 20 are sounded by the edge frame 200. The two sides of upper cover 2 are extended vertically downwards as two lateral sides 21. The inner walls of the two lateral sides 21 have locking portions 210. The locking portions 210 are used to fix the strips 10 on the two side of the seat 1 so as to connect the seat 1 to the upper cover 2. A portion without inserting holes 201 on the receiving surface 20 is installed in at least one of the ribs 202 for receiving the CPU chip module. The two sides of the rib 202 have the inserting holes 201. The rib 202 is positioned on the place between the two neighbor inserting holes 201. Besides, the height of the rib 202 protruded from the receiving surface 20 is equal to the height of the edge frame 200 protruded from the receiving surface 20. The length of the rib 202 is greater than one-thirds of the width of the receiving surface 20 (in the embodiment, the ribs 202 passes through the receiving surface 20). The above-mentioned ribs 202 are arranged intercrossedly on the receiving surface 20 and the ribs 202 are positioned on middle place of the receiving surface 20. Because the receiving surface 20 of the upper cover 2 on the portion without the inserting holes 201 has at least one of the ribs 202 so as to receive the CPU chip module, the ribs 202 increase the strength of the upper cover 2. Because of the ribs 202, the upper cover 2 is avoided to become warped when the upper cover 2 is pressed by physical strength. Also, the chip module is connected to the electric connector with higher quality of electric connection. Because the height of the rib 202 protruded from the receiving surface 20 is equal to the height of the edge frame 200 protruded from the receiving surface 20, the bottom of the peripheries of receiving surface 20 is supported by the edge frame 200 after inserting the CPU chip module in the receiving surface 20. The portion with inserting holes 201 on the receiving surface 20 is supported by the ribs 202. The central area of the upper cover 2 may become warped and changed shape thereof, because the locking force between the CPU chip module and a radiator and a fan thereof exceeds the tolerance value thereof. The situation of the central area of the upper cover 2 out of shape is avoided so as to assure the CPU chip module without damage in shaking circumstance.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric connector for electric connection of a chip module comprising:

a seat;

an upper cover connecting movably to the seat; the seat slideable horizontally with respect to the upper cover;

a receiving surface being installed in the upper cover for receiving the chip module; and a plurality of ribs; and at least one rib of the plurality of ribs being installed inside of the receiving surface, wherein the length of the at least one rib is greater than one-thirds of the receiving surface.

2. The electric connector as claimed in claim 1, wherein the ribs are positioned between the areas of the two neighboring inserting holes.

3. The electric connector as claimed in claim 1, wherein the rib passes through the full receiving surface.

4. The electric connector as claimed in claim 1, wherein the ribs are arranged intercrossedly on the receiving surface.

5. The electric connector as claimed in claim 1, wherein the ribs are protruded from the receiving surface so as to receive the chip module.

6. The electric connector as claimed in claim 4, wherein the length of the periphery protruded from the receiving surface is equal to the length of the edge frame.

7. The electric connector as claimed in claim 1, wherein the ribs are positioned on the central area of the receiving surface.

8. The electric connector as claimed in claim 1, wherein the electric connector has a driving device used to slide the seat with respect to the upper cover; the driving device has a joystick; and the joystick has as spindle, an operation portion approximately vertically to the spindle and a pressing portion protruded from the spindle.

* * * * *